US009623426B2

(12) United States Patent
Schurle

(10) Patent No.: US 9,623,426 B2
(45) Date of Patent: Apr. 18, 2017

(54) ATOMIZER NOZZLE FOR A SANITARY WATER OUTLET AND SANITARY OUTLET FITTING WITH A WATER OUTLET

(71) Applicant: Neoperl GmbH, Mullheim (DE)

(72) Inventor: Holger Schurle, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 0 days.

(21) Appl. No.: 14/768,939

(22) PCT Filed: Jan. 21, 2014

(86) PCT No.: PCT/EP2014/000152
§ 371 (c)(1),
(2) Date: Aug. 19, 2015

(87) PCT Pub. No.: WO2014/139615
PCT Pub. Date: Sep. 18, 2014

(65) Prior Publication Data

US 2016/0001307 A1 Jan. 7, 2016

(30) Foreign Application Priority Data

Mar. 11, 2013 (DE) ..... 20 2013 002 283 U

(51) Int. Cl.
*B05B 1/18* (2006.01)
*B05B 1/34* (2006.01)
(Continued)

(52) U.S. Cl.
CPC ..... *B05B 1/3436* (2013.01); *B05B 1/185* (2013.01); *E03C 1/0408* (2013.01); *E03C 1/0409* (2013.01); *E03C 1/08* (2013.01)

(58) Field of Classification Search
CPC ..... B05B 1/185; B05B 1/3421; B05B 1/3431; B05B 1/3436; E03C 1/0408; E03C 1/08
See application file for complete search history.

(56) References Cited

U.S. PATENT DOCUMENTS 5,711,488 A * 1/1998 Lund ..... B05B 1/3436 239/333
6,371,389 B1 * 4/2002 Bickart ..... B05B 1/3436 239/463
(Continued)

FOREIGN PATENT DOCUMENTS

CA 2682588 4/2011
DE 20111056 9/2001
(Continued)

*Primary Examiner* — Ryan Reis
(74) *Attorney, Agent, or Firm* — Volpe and Koenig, P.C.

(57) ABSTRACT

An atomizer nozzle (1) for a sanitary water outlet, which atomizer nozzle (1) is intended for atomizing water under pressure. The characterizing feature of the atomizer nozzle (1) according to the invention is that the atomizer nozzle (1) has a swirl chamber (2), in which at least one feed channel (4) that is oriented transversely in relation to the longitudinal axis of the nozzle and runs approximately tangentially into the swirl chamber (2) opens out, wherein the swirl chamber (2) tapers in the outflow direction, in the direction of a nozzle channel (5). The atomizer nozzle (1) can be used to produce a water jet of a homogeneous jet pattern that gives the impression of a voluminous water jet in spite of having a low volumetric flow.

16 Claims, 6 Drawing Sheets

(51) Int. Cl.
*E03C 1/04* (2006.01)
*E03C 1/08* (2006.01)

(56) References Cited

U.S. PATENT DOCUMENTS

| | | | | |
|---|---|---|---|---|
| 6,612,510 | B1 * | 9/2003 | Fox | B05B 1/02 239/3 |
| 7,478,767 | B2 * | 1/2009 | Wu | B05B 1/3426 137/812 |
| 8,313,045 | B2 * | 11/2012 | Levitsky | B05B 1/3426 239/468 |
| 2003/0042331 | A1 * | 3/2003 | Lu | B05B 1/1654 239/436 |
| 2011/0108640 | A1 | 5/2011 | Grohe et al. | |
| 2012/0217322 | A1 * | 8/2012 | Songbe | B05B 1/3436 239/469 |
| 2013/0221132 | A1 | 8/2013 | Egli | |

FOREIGN PATENT DOCUMENTS

| | | |
|---|---|---|
| EP | 2301670 | 3/2011 |
| WO | 2004016358 | 2/2004 |
| WO | 2009126987 | 10/2009 |
| WO | 2011055036 | 5/2011 |
| WO | 2012055051 | 5/2012 |

* cited by examiner 1
14
14
1
1
21

1
22
21
23
23

10
1
14
1
14
6
6
10
21
22

6
6
5
22
21

21
21
21

ATOMIZER NOZZLE FOR A SANITARY WATER OUTLET AND SANITARY OUTLET FITTING WITH A WATER OUTLET

BACKGROUND

The present invention relates to an atomizer nozzle for a sanitary water outlet, for the purpose of atomizing water which is subjected to pressure, which atomizer nozzle has a swirl chamber into which opens out at least one feed channel, which is oriented transversely to the longitudinal axis of the nozzle and runs tangentially into the swirl chamber, wherein at least one inlet channel is arranged upstream of each feed channel, as seen in the flow direction, and wherein the swirl chamber tapers, in the outflow direction, towards a nozzle channel, at the end region of which the water jet exits into the atmosphere.

The invention also concerns a sanitary outlet fitting having a water outlet which has at least one atomizer nozzle of the type mentioned in the introduction.

WO 2012/055051 A1 has already disclosed an apparatus which is intended for spraying a liquid subjected to pressure and can serve as a mouthpiece of a sanitary outlet fitting or as a shower head. The previously known apparatus has a central feed channel for the liquid, said channel running along the apparatus axis. A plurality of vortex chambers are provided at a distance around the apparatus axis and each have an inlet, for feeding the liquid into the respective vortex chamber, and an outlet nozzle, for the exit of a liquid jet from the vortex chamber. The vortex chambers are connected to the feed channel via inlet channels, which are arranged essentially transversely to the apparatus axis. Each of the outlet nozzles is arranged obliquely in relation to the longitudinal axis of the apparatus such that liquid jets exiting from the outlet nozzles come into contact with one another at a predetermined distance from the outlet nozzles. The previously known apparatus can advantageously be used wherever it is desired to have a good cleaning performance along with a low volume flow. The previously known apparatus, however, has a comparatively complex structure, which can make the apparatus difficult to produce. Furthermore, the pattern of the water jet exiting from the previously known apparatus is also worthy of improvement.

WO 2004/016358 A1 discloses an atomizer nozzle of the type mentioned in the introduction for a sanitary water outlet, for the purpose of atomizing water which is subjected to pressure. The atomizer nozzle has a circular swirl chamber into which opens out a feed channel, which is oriented transversely to the longitudinal axis of the nozzle and runs tangentially into the swirl chamber, wherein at least one inlet channel is arranged upstream of each feed channel, as seen in the flow direction, and wherein the swirl chamber tapers, in the outflow direction, towards a nozzle channel, at the end region of which the water jet exits into the atmosphere. The construction of this previously known atomizer nozzle, however, is likewise relatively complex, which can make the atomizer nozzle, for example, difficult to produce. Furthermore, the pattern of the exiting water jet is also worthy of improvement.

SUMMARY

It is therefore an object to create an atomizer nozzle of the type mentioned in the introduction which can be produced with low outlay and is distinguished by a homogeneous pattern of the exiting water jet. It is also an object to create a sanitary outlet fitting which has a water outlet and, in respect of its water outlet, can be produced with low outlay and is distinguished by a homogeneous pattern of the exiting water jet.

This object is achieved, in the case of the atomizer nozzle of the type mentioned in the introduction that includes one or more features of the invention.

The atomizer nozzle according to the invention is intended for a sanitary water outlet, in order to atomize water which is subjected to pressure, and thus to form a homogeneous water jet. The atomizer nozzle according to the invention has a swirl chamber into which opens out at least one feed channel, which is oriented transversely to the longitudinal axis of the nozzle and runs tangentially to the swirl chamber such that the water flowing in the swirl chamber is swirled around the longitudinal axis of the swirl chamber. The swirl chamber tapers in the outflow direction towards a nozzle channel, and therefore the water jet, which is made to rotate in the swirl chamber around the longitudinal axis of the swirl chamber, is brought together in increasingly smaller circular paths and is directed through the nozzle channel, until the water jet exits, at the end region of the nozzle channel, into the atmosphere, where a fluid lamella forms, said lamella bursting, along the free peripheral region of its circumference, into individual droplets which are fine enough as to form a homogeneous water jet formed from fine water droplets. In the case of the atomizer nozzle according to the invention, provision is made for the atomizer nozzle to have a basic structure, which has an insertion opening on the inflow side, for at least one groove, which is intended for forming an inlet channel, to be provided on the circumferential wall of the insertion opening, for it to be possible for a plug to be inserted into the insertion opening as far as an annular shoulder, which runs around the inner circumference and has at least one groove, which is provided in order to form a feed channel, and for the plug to form that wall of the inlet and feed channels which is directed towards the plug. The atomizer nozzle according to the invention thus has a basic structure which has an insertion opening on the inflow side. At least one groove, which is intended for forming an inlet channel, is provided on the circumferential wall of the insertion opening. The plug can be inserted as far as an annular shoulder, which runs around the inner circumference and is interrupted by at least one groove, which is provided in order to form a feed channel. Following insertion of the plug into the insertion opening on the inflow side of the basic nozzle structure, the outside of the plug butts against the grooves such that said plug forms that wall of the inlet and feed channels which is directed towards the plug. This configuration of the atomizer nozzle according to the invention significantly simplifies the production of said atomizer nozzle.

In order that the water stream which is made to rotate in the swirl chamber around the longitudinal axis of the swirl chamber can be guided together, in the direction towards the nozzle channel, in increasingly small circular paths, a preferred embodiment of the invention provides for the swirl chamber, in the direction towards the nozzle channel, to be in the form of a funnel. A particularly advantageous embodiment of the invention here provides for the swirl chamber to be in the form in particular of a funnel which is conical or in the form of a rotational hyperboloid.

A preferred embodiment of the invention provides for a central protrusion, which is oriented in the longitudinal direction of the nozzle, to project into the swirl chamber. By virtue of the protrusion, which projects into the swirl chamber, the water jet, which is made to rotate along the wall of the swirl chamber, cannot yield into the center of the swirl chamber.

In order that it is not possible in particular for the water streams flowing in from a plurality of feed channels to affect one another and form vortices in an uncontrolled manner, it is advantageous if the protrusion projects, beyond an imaginary plane through the mouth openings of the feed channels, in the direction of the nozzle channel.

It is particularly advantageous here if the protrusion is provided on that end side of the plug which is directed towards the swirl chamber.

In order to render the atomizer nozzle according to the invention easier still to produce and design, it is advantageous if the at least one inlet channel of each feed channel is oriented in the longitudinal direction of the nozzle.

In order for it to be possible for the water coming from the water-supply network to be routed straightforwardly to the at least one feed channel, which is oriented transversely to the longitudinal axis of the nozzle, it is advantageous if an inlet channel, which is oriented in the longitudinal direction of the nozzle, is arranged upstream of each feed channel, as seen in the flow direction.

The pattern of the water jet exiting from the atomizer nozzle according to the invention is improved yet further if the atomizer nozzle has a plurality of feed channels which are distributed preferably at uniform intervals in the circumferential direction.

A preferred embodiment of the invention provides for the atomizer nozzle to be configured in the form of a hollow-cone nozzle. The water flowing in from the supply network flows tangentially into the swirl chamber of the atomizer nozzle configured in the form of a hollow-cone nozzle, and this gives rise there to a fluid vortex. The water, which flows through the nozzle channel in circular paths, forms, at the outflow end region of the nozzle channel, a lamella, which bursts into individual droplets along its end edge.

In order for it to be possible for the water flowing out in the form of a hollow cone to have good shaping, it is expedient if the outflow end region of the nozzle channel has a cross-sectional widened portion which widens in the direction of the outflow end and is preferably of spherical configuration.

In the case of the outlet fitting of the type mentioned in the introduction, the solution according to the invention consists in that the water outlet thereof has at least one atomizer nozzle with one or more features of the invention.

Preferred exemplary embodiments of the invention here provide for the water outlet to be designed in the form of a shower head or in the form of a jet regulator.

A preferred embodiment of the invention provides for the jet-regulator-form water outlet to be installed in the sanitary outlet fitting on the outflow side.

In order for the water jet flowing out of the sanitary outlet fitting to be one which, despite the comparatively small volume flow, has a sufficiently wide jet cross section, it is advantageous if the water outlet has at least two atomizer nozzles, which are distributed over the cross section of the water outlet.

The production of the outlet fitting in the region of the water outlet thereof is significantly simplified if the water outlet has a housing or a basic structure, and if the housing or the basic structure has provided in it at least one insertion opening, into which the basic structure of an atomizer nozzle can be inserted preferably in a releasable manner.

In order for it to be possible for the particles of dirt possibly entrained in the water to be filtered out before such particles of dirt adversely affect the function of the atomizer nozzles provided in the water outlet, it is advantageous if an attachment screen or a filter screen is arranged in front of the jet regulator, and if the attachment screen or filter screen can be fastened, preferably in a releasable manner, on the inflow end side of the jet regulator.

In order that the water can flow out in a state in which it is well distributed over the entire conduit cross section, even in the case of comparatively small atomizer nozzles, it is advantageous if the water outlet bears at least three atomizer nozzles, and if the atomizer nozzles are arranged on a circular path, running preferably concentrically in relation to the longitudinal axis of the shower head, or in a linear arrangement. A linear arrangement of the atomizer nozzles is recommended, for example, if the atomizer nozzles should be arranged in a star-shaped manner in relation to one another, or if the atomizer nozzles, in particular in a rectangular water outlet, should be arranged in at least one linear arrangement in relation to one another.

The water exiting from the atomizer nozzles is, in the first instance, in the form of a hollow cone, which is formed by a wall of water which runs around in the form of a circle. In order also for the water to be provided in the interior of each hollow cone, and in order also to promote the formation of a homogeneous jet over the cross section of the jet, it is advantageous if the longitudinal axes of the atomizer nozzles are inclined in relation to one another such that liquid jets exiting from the nozzles come into contact with one another at a predetermined distance from the nozzles.

A preferred embodiment of the invention here provides for the longitudinal axes of the atomizer nozzles to be arranged at an angle of 1 degree to 10 degrees to the longitudinal axis of the water outlet and, in particular, to the longitudinal axis of the housing thereof.

BRIEF DESCRIPTION OF THE DRAWINGS

Developments according to the invention can be gathered from the claims in conjunction with the drawing and the description of the Figures. The invention will be described in yet more detail below, with reference to the various exemplary embodiments, in the drawings, in which:

DETAILED DESCRIPTION OF THE PREFERRED EMBODIMENTS

FIGS. 1 to 16 illustrate an atomizer nozzle 1 which is intended for a sanitary water outlet for atomizing water which is subjected to pressure. The atomizer nozzle 1 is intended to use a small volume flow to form a homogeneous water jet which nevertheless appears to be voluminous.

The atomizer nozzle 1 has a swirl chamber 2 which, on the inflow side, has a chamber portion 3 which is essentially cylindrical or disk-shaped over its clear cross section. Opening out in the swirl chamber 2 is at least one feed channel 4, which is oriented transversely, and preferably at right angles, to the longitudinal axis of the nozzle and runs tangentially into the swirl chamber 2.

Figures 10, 11, 12, 13, 14, 15, 16:
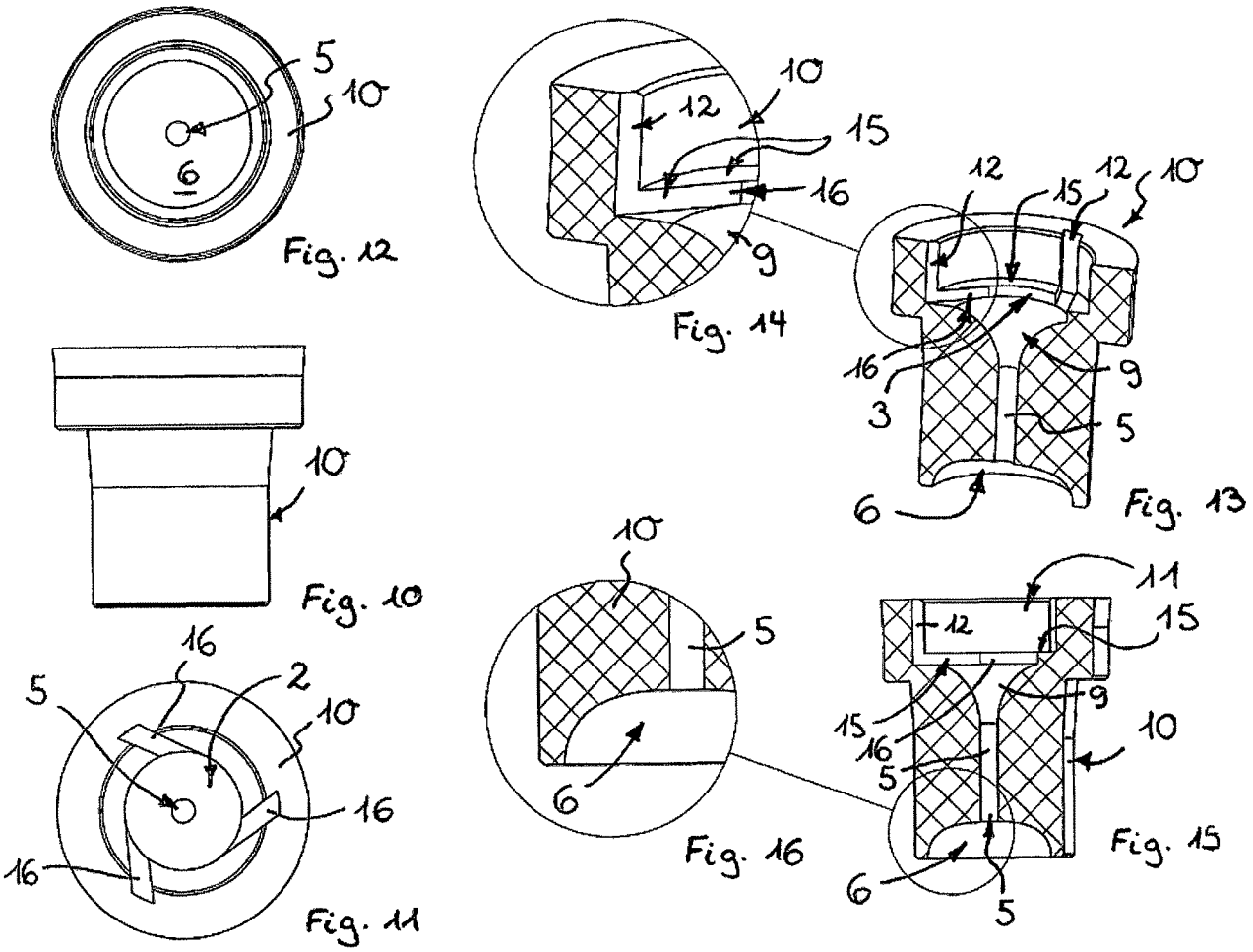
FIG. 10 shows a side view of the constituent part which belongs to the atomizer nozzle according to FIGS. 1 to 3 and is provided in the form of a basic nozzle structure.
FIG. 11 shows a plan view of the inflow side of the basic nozzle structure from FIG. 10.
FIG. 12 shows a plan view of the outflow side of the basic nozzle structure from FIGS. 10 and 11.
FIG. 13 shows a perspective longitudinal section of the basic nozzle structure from FIGS. 10 to 12.
FIG. 14 shows a detail of the basic nozzle structure, as shown in longitudinal section, in the region of a feed channel leading to a swirl chamber.
FIG. 15 shows a longitudinal section of the basic nozzle structure from FIGS. 10 to 14.
FIG. 16 shows a detail of the basic nozzle structure from FIG. 15 as seen in longitudinal section in the region of a hollow-cone nozzle on the outflow side.
Figures 17, 18, 19, 20, 21, 22, 23:
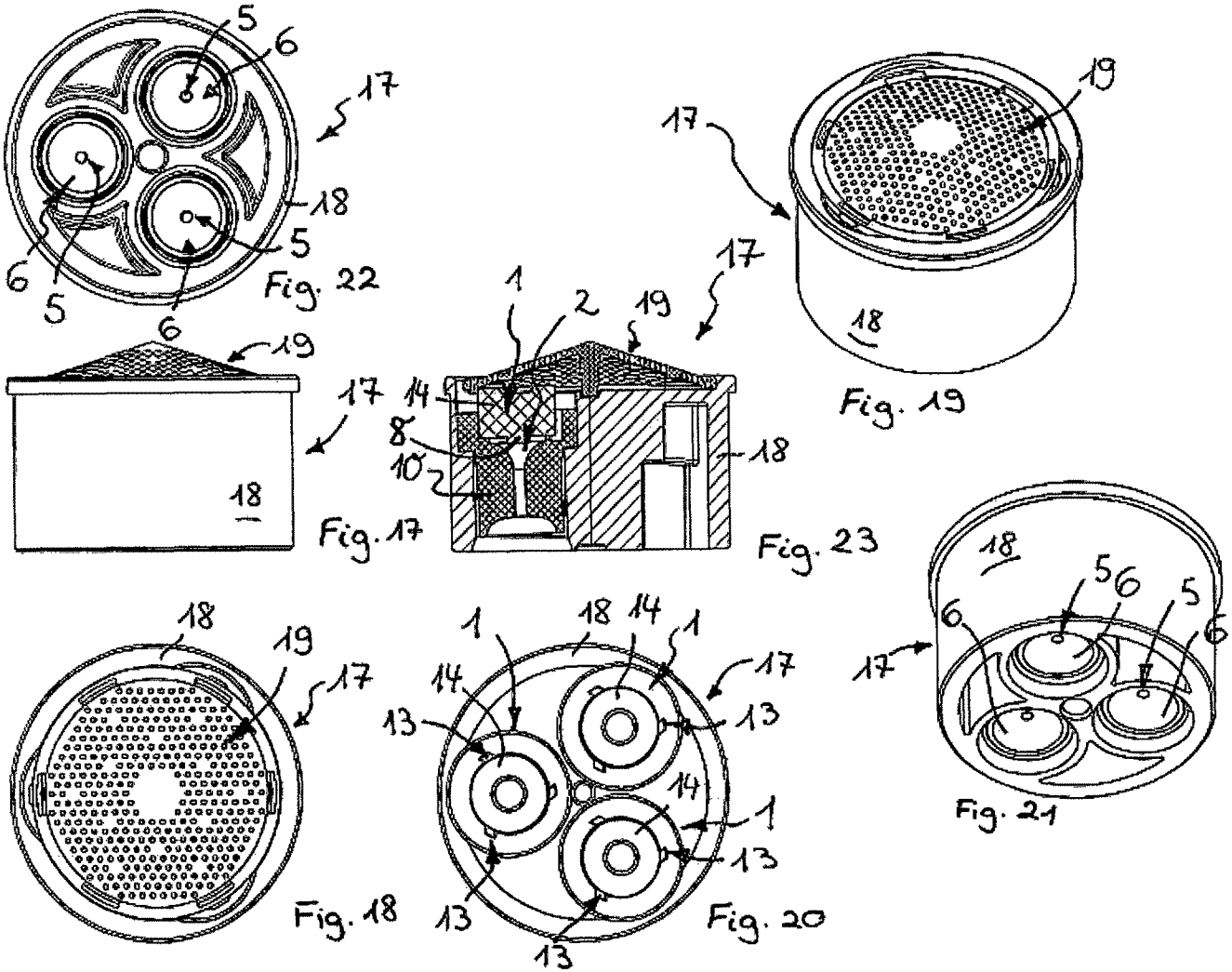
FIG. 17 shows a side view of a water outlet which is intended for a sanitary outlet fitting and, in this case, is configured in the form of a jet regulator.
FIG. 18 shows a plan view of the inflow side of the jet regulator from FIG. 17, wherein in this case it is possible to see a filter screen or attachment screen arranged in front of the jet regulator.
FIG. 19 shows a perspective plan view of the inflow side of the jet regulator from FIGS. 17 and 18.
FIG. 20 shows a plan view of the inflow side of the jet regulator from FIGS. 17 to 19, the filter/attachment screen having been removed.
FIG. 21 shows a perspective plan view of the outflow side of the jet regulator from FIGS. 17 to 20.
FIG. 22 shows a plan view of the outflow side of the jet regulator from FIGS. 17 to 21.
FIG. 23 shows a longitudinal section of the jet regulator from FIGS. 17 to 22.
Figure 25:
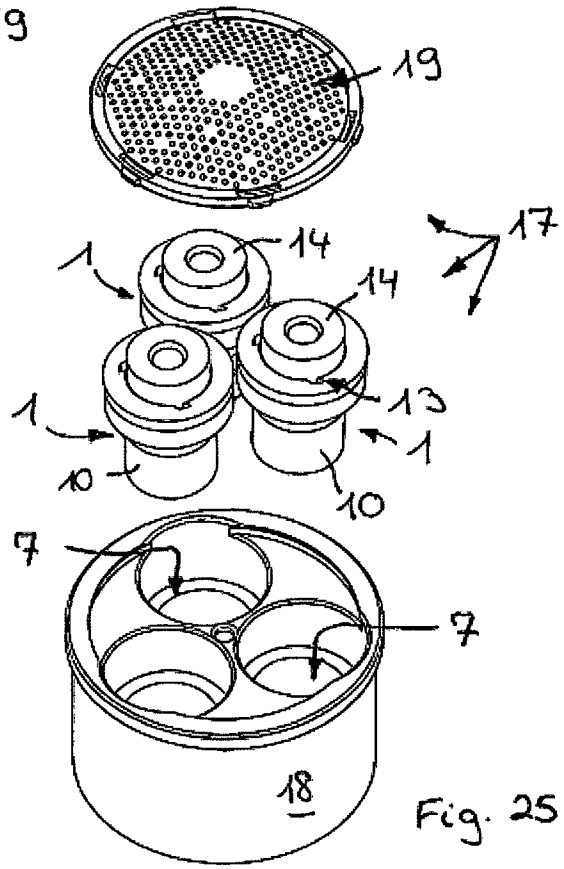
FIG. 25 shows the constituent parts of the jet regulator from FIGS. 17 to 24 in an exploded perspective illustration which has been rotated in relation to FIG. 24.
Figure 24:
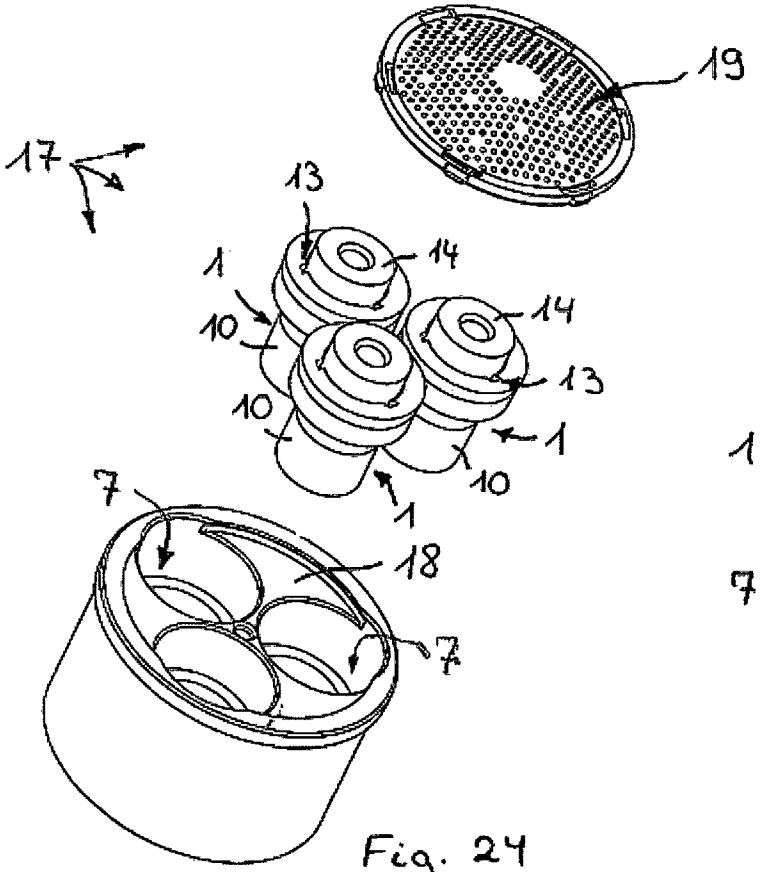
FIG. 24 shows an exploded perspective illustration of the constituent parts of the jet regulator from FIGS. 17 to 23.

As can be seen in the plan view in FIG. 11, in which are illustrated the grooves 16, each forming a feed channel, a plurality of feed channels 4, which are spaced apart uniformly from one another in the circumferential direction, open out here in the swirl chamber 2. The swirl chamber 2 tapers in the form of a funnel, in the outflow direction, towards a nozzle channel 5, which nozzle channel 5, at its outflow end region, has a cross-sectional widened portion 6 which widens in the direction of the outflow end and is preferably of spherical or rounded configuration here. The funnel-form portion 9 of the swirl chamber is configured, over its clear cross section, such that the swirl chamber, in the direction towards the nozzle channel 5, is in the form of a funnel which is conical or in the form of a rotational hyperboloid.

Figures 1, 2, 3, 4, 5, 6, 7, 8, 9:
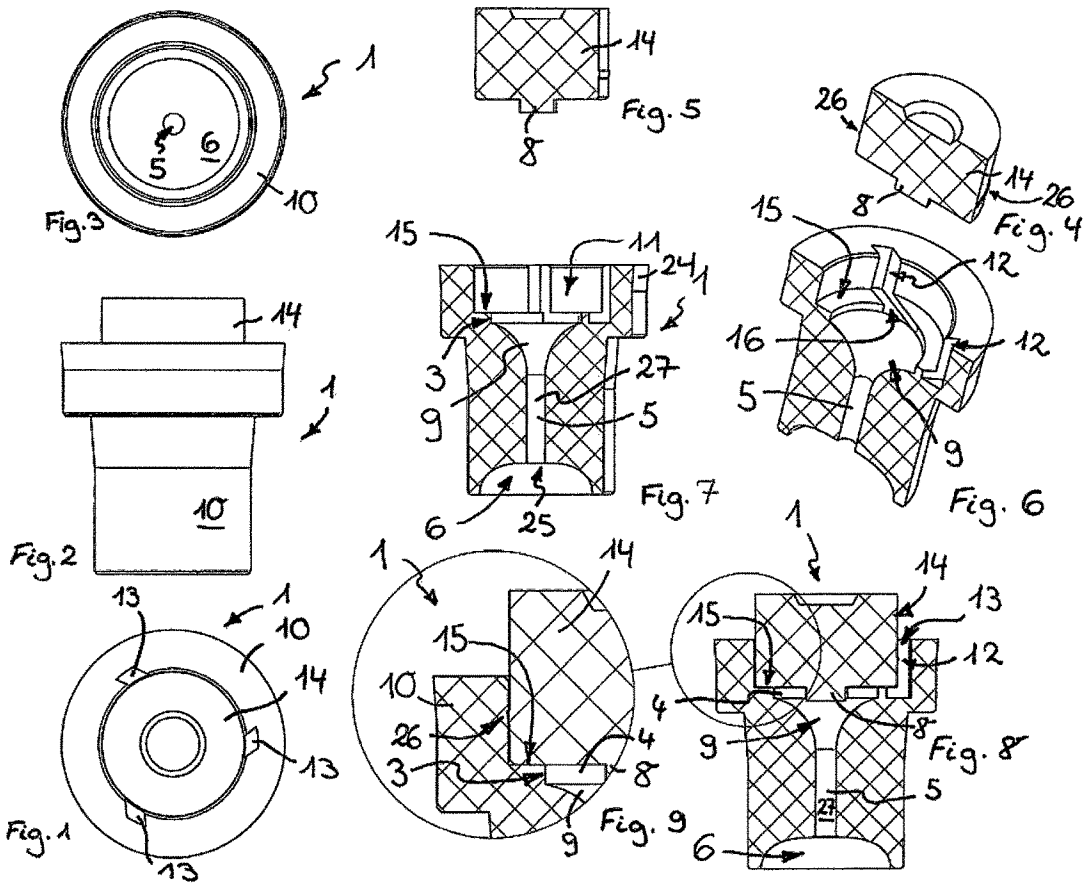
FIG. 1 shows an atomizer nozzle which is intended for a sanitary water outlet and is provided for forming or atomizing water which is subjected to pressure, wherein the atomizer nozzle is shown here in a plan view of its inflow side.
FIG. 2 shows a side view of the atomizer nozzle from FIG. 1.
FIG. 3 shows a plan view of the outflow side of the atomizer nozzle from FIGS. 1 and 2.
FIG. 4 shows a longitudinal section of a plug-form constituent part of the atomizer nozzle shown in FIGS. 1 to 3.
FIG. 5 shows a longitudinal section of the plug-form constituent part from FIG. 4.
FIG. 6 shows a perspective longitudinal section of a constituent part which belongs to the atomizer nozzle shown in FIGS. 1 to 3 and is provided in the form of a basic nozzle structure.
FIG. 7 shows a longitudinal section of the constituent part from FIG. 6, which is provided in the form of the basic nozzle structure.
FIG. 8 shows the atomizer nozzle according to FIGS. 1 to 3 in a longitudinal section through its constituent parts formed from the plug and basic nozzle structure.
FIG. 9 shows a detail of the atomizer nozzle, as seen in longitudinal section, in the region of the plug inserted into the basic nozzle structure.

So that the streams of water flowing out of the openings of the feed channels 4 cannot adversely affect one another, a central protrusion 8, which is oriented in the longitudinal direction of the nozzle, projects into the swirl chamber 2. As can be seen in FIG. 8, this protrusion 8 projects, beyond an imaginary plane through the mouth openings of the feed channels 4, in the direction of the nozzle channel 5.

The atomizer nozzle 1 illustrated here has a basic structure 10, which has an insertion opening 11 on the inflow side. At least one groove 12, which is intended for forming an inlet channel, is provided on the circumferential wall of the insertion opening 11. In each case one inlet channel 13, which is oriented in the longitudinal direction of the nozzle, is arranged upstream of each feed channel 4, as seen in the flow direction. A plug 14 can be inserted into the insertion opening 11 as far as an annular shoulder 15, which runs around the circumference. The annular shoulder 15 is interrupted by at least one groove 16, which is provided in order to form a feed channel 4. While the outer circumference of the plug 14 closes the at least one groove 12 in respect of an inlet channel 13, the end side of the plug 14 closes the at least one groove 16 in respect of a feed channel 4. The protrusion 8 is provided on that end side of the plug 14 which is directed towards the swirl chamber 2. The atomizer nozzle 1 has a plurality of feed channels and, in this case, three feed channels 4, which are distributed at uniform intervals in the circumferential direction.

FIGS. 17 to 25 illustrate a jet regulator 17 which is intended as a water outlet of a sanitary outlet fitting (not shown specifically here) and has a plurality of the atomizer nozzles 1 shown in FIGS. 1 to 16. The jet regulator 17, which is shown in FIGS. 17 to 25, has at least two, and preferably three, atomizer nozzles 1, which are distributed over the cross section of the jet regulator 17, which serves as a water outlet. The jet regulator 17 has a housing 18, in which is provided at least one insertion opening 7, into which the basic structure 10 of an atomizer nozzle 1 can be inserted preferably in a releasable manner. It can be seen in FIGS. 17 and 23 to 25 that an attachment screen or filter screen 19 is arranged in front of the jet regulator 17. This attachment screen or filter screen 19 here can be fastened, preferably in a releasable manner, on the inflow end side of the jet regulator. It can be seen in FIG. 23 that the longitudinal axes of the atomizer nozzles 1 provided in the jet regulator 17 are inclined in relation to one another such that liquid jets exiting from the nozzles come into contact with one another at a predetermined distance from the nozzles. The atomizer nozzles 1 here define a longitudinal nozzle axis which runs at an angle of 1 degree to 10 degrees to the longitudinal axis of the jet regular 17 and, in particular, to the longitudinal axis of the housing thereof.

A water jet which is formed from fine water droplets, is generated from a small volume flow, is distinguished by a homogeneous jet pattern and gives the impression of a voluminous water jet exits from the jet regulator 17 illustrated here.

Figures 26, 27:
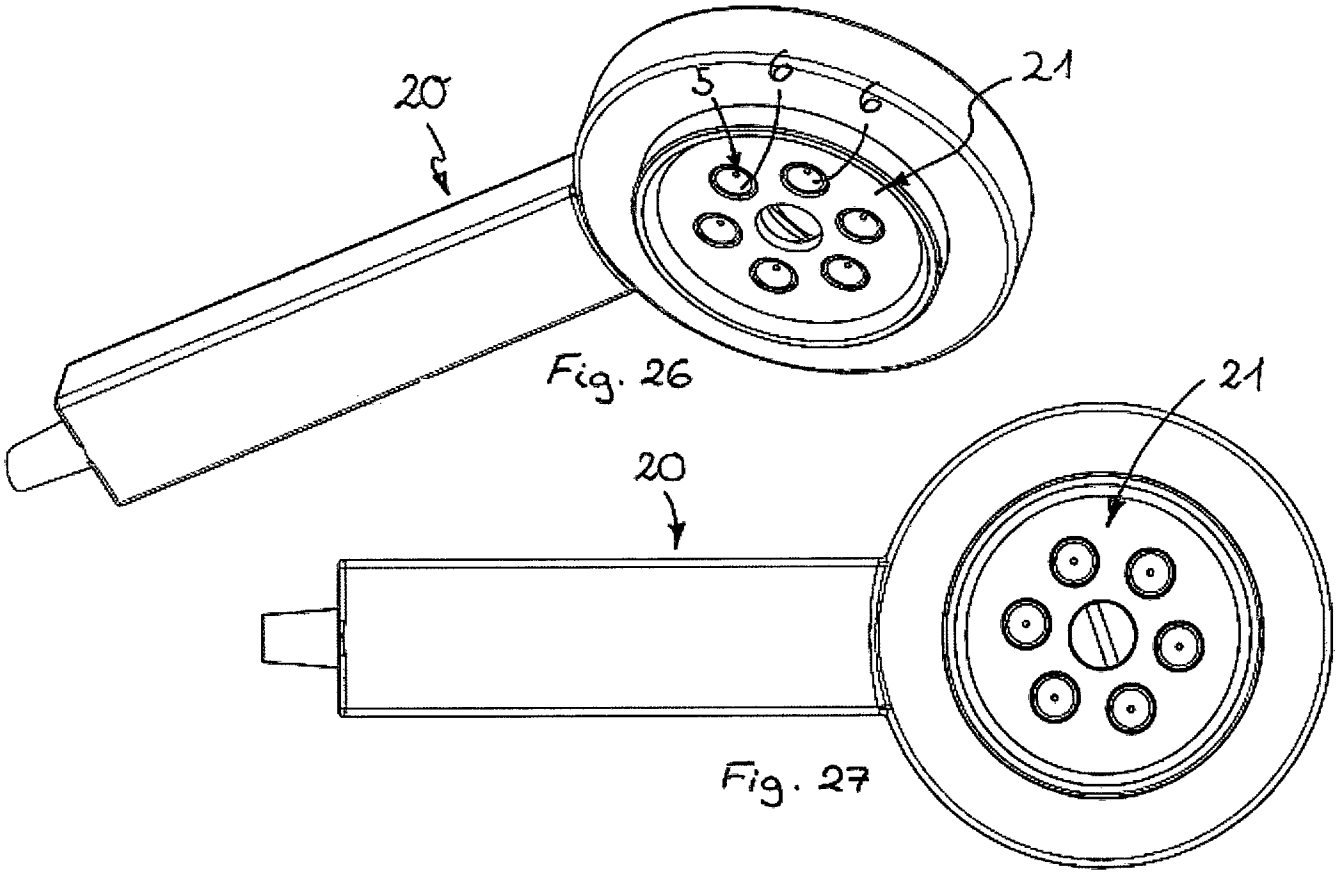
FIG. 26 shows an outlet fitting which is configured in the form of a hand-held shower attachment and has a water outlet designed in the form of a shower head, wherein the hand-held shower attachment is illustrated here in a perspective plan view of the outflow side of the shower head.
FIG. 27 shows a plan view of the outflow side of the shower head of the hand-held shower attachment from FIG. 26.
Figures 28, 29, 30, 31, 32, 33:
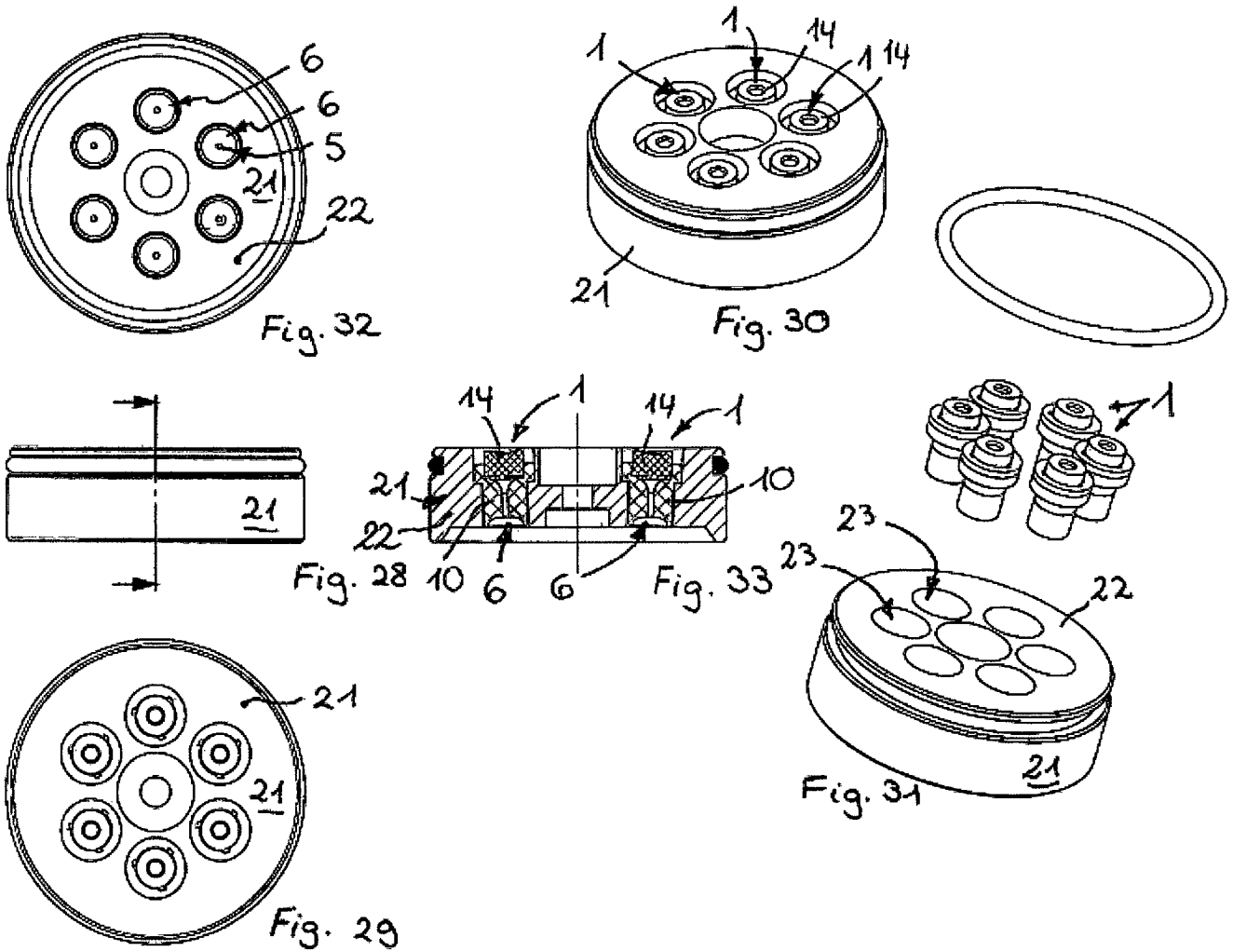
FIG. 28 shows a side view of the shower head of the hand-held shower attachment shown in FIGS. 26 and 27.
FIG. 29 shows a plan view of the inflow side of the shower head from FIG. 28.
FIG. 30 shows a perspective plan view of the inflow side of the shower head from FIGS. 28 and 29.
FIG. 31 shows an exploded perspective illustration of the constituent parts of the shower head according to FIGS. 28 to 30.
FIG. 32 shows a plan view of the outflow side of the shower head according to FIGS. 28 to 31.
FIG. 33 shows a longitudinal section of the shower head from FIGS. 28 to 32.

FIGS. 26 and 27 illustrate a sanitary outlet fitting which is designed in the form of a hand-held shower attachment 20 and of which the water outlet is configured in the form of a shower head 21. The shower head 21, which is illustrated in more detail in FIGS. 28 to 32, has at least two atomizer nozzles 1, which are distributed over the cross section of the shower head 21. The shower head 21 has a housing or basic structure 22, in which is provided at least one insertion opening 23, into which the basic structure 10 of an atomizer nozzle 1 can be inserted preferably in a releasable manner. The shower head 21 has provided in it more than three, and here in particular six, atomizer nozzles 1, which are arranged on a circular path running concentrically in relation to the longitudinal axis of the shower head. It is also the case that the longitudinal axes of the atomizer nozzles 1 provided in the shower head 21 are inclined in relation to one another such that liquid jets exiting from the nozzles come into contact with one another at a predetermined distance from the nozzles. The longitudinal axes of the atomizer nozzles 1 here define a longitudinal nozzle axis which runs at an angle of 1 degree to 10 degrees to the longitudinal axis of the water outlet, which is designed in the form of a shower head 21, and, in particular, to the longitudinal axis of the basic structure 22 thereof.

The water exits from the hollow-cone nozzles 6 of the atomizer nozzles 1 in a spray cone of 15 degrees to 40 degrees in each case. This results in the formation of a fluid lamella, which bursts into individual droplets along its free outline or its end edge. These fluid droplets of the water flowing out of the atomizer nozzles 1 combine to form an overall jet which is homogeneous over the entire cross section of the jet and, despite its comparatively small volume flow, gives the appearance of a voluminous water jet with a customary level of cleaning force.

It is clear from the exemplary embodiments according to FIGS. 17 to 33 that the atomizer nozzle 1 shown in FIGS. 1 to 16 allows modular configuration of the water outlet intended for a sanitary outlet fitting. It is indeed the case that the water passing through the atomizer nozzle 1 exits there in the form of a hollow cone, but the inclined arrangement of a plurality of atomizer nozzles results in the formation of a homogeneous water jet which is formed from fine water droplets over the entire cross section of the jet. It can be seen from FIGS. 2, 6, 7 and 8 that the peripheral region on the inflow side of the basic nozzle structure has a basic-nozzle-structure portion 24 which widens counter to the inflow direction and can form a solid sealing lip once the basic nozzle structure has been inserted into the housing 18 or the basic structure 22 of a water outlet. This sealing lip formed by the portion 24 has a dual sealing function and retaining function, as a result of which the basic nozzle structure 10 is retained, for all practical purposes in the manner of a barb, in the housing 18 or in the basic structure 22 of the water outlet. It is also possible, however, for the basic nozzle structure 10 to be snap-fitted, welded, or fixed releasably or non-releasably in some other way, in the insertion openings 7, 23 provided in the basic structure 22 or in the housing 18 of the water outlet. It has been found that the nozzle channel 5 should have, at its opening which opens out into the atmosphere, a break-away edge 25, angled at less than/equal to 90 degrees, in order to achieve the best possible atomizing operation in the atomizer nozzle 1. It can be seen in the detail view in FIG. 9 that the plug 14 has provided on it at least one preferably encircling sealing and/or retaining claw 26, which retains said plug 14 in the insertion opening 11 of the basic nozzle structure 10. It is clear in FIGS. 7 and 8 that the portion 27 of the nozzle channel 5, said portion being designed preferably with a constant cross section, is of comparatively long configuration and has a length of at least ⅓ of the length of the basic nozzle structure, preferably a length of ⅓ to ½ of the basic nozzle structure 10. The length of the spray cone formed by the atomizer nozzle 1 can be defined, and the outflowing water jet can be concentrated even more, over the length of the nozzle channel 5 and the portion 27 thereof which is configured with a constant cross section. The individual constituent parts of the atomizer nozzle 1 can be produced in a cost-effective and reliable manner. Although the feed and inlet channels 4, 13 have a comparatively small cross section, these components of the atomizer nozzle 1 can be produced with low outlay and a sufficient level of precision. The atomizer nozzle 1 illustrated here makes it possible to produce a water outlet which facilitates minimal water consumption and nevertheless, even at low pressures of for example 2 to 3 bar, provides for good and full-surface-area wetting by means of the exiting water jet.

LIST OF DESIGNATIONS

1 Atomizer nozzle
2 Swirl chamber
3 (Cylindrical or disk-shaped) chamber portion
4 Feed channel
5 Nozzle channel
6 Hollow-cone nozzle
7 Insertion opening
8 Protrusion
9 (Funnel-shaped) chamber portion
10 Basic nozzle structure
11 Insertion opening
12 Groove
13 Inlet channel
14 Plug
15 Annular shoulder
16 Groove
17 Jet regulator
18 Housing
19 Attachment screen or filter screen
20 Hand-held shower attachment
21 Shower head
22 Basic structure
23 Insertion opening
24 Portion
25 Nozzle break-away edge
26 Retaining claw
27 Portion

The invention claimed is:

1. An atomizer nozzle (1) for a sanitary water outlet, for atomizing water which is subjected to pressure, said atomizer nozzle (1) comprising a swirl chamber (2) in which at least one feed channel (4) opens, which is oriented transversely to a longitudinal axis of the nozzle and runs tangentially into the swirl chamber (2), at least one inlet channel (13) is arranged upstream of each said at least one feed channel (4), as seen in a flow direction, and the swirl chamber (2) tapers, in an outflow direction, towards a nozzle channel (5), at an end region of which a water jet exits into atmosphere, a basic structure (10) which has an insertion opening (11) on an inflow side, at least one groove (12), which forms the inlet channel (13), is provided on a circumferential wall of the insertion opening (11), a plug (14) that is insertable into the insertion opening (11) as far as an annular shoulder (15), which runs around an inner circumference of the insertion opening and has at least one groove (16), is provided in order to form the at least one feed channel (4), and the plug (14) forms walls of the inlet and the feed channels (13, 4) which are directed towards the plug (14), wherein a central protrusion (8), which is oriented in the longitudinal direction of the nozzle, projects beyond the shoulder in the outflow direction into the swirl chamber (2).

2. The atomizer nozzle as claimed in claim 1, wherein the swirl chamber (2), in the direction of the nozzle channel (5), has a funnel shape.

3. The atomizer nozzle as claimed in claim 1, wherein the protrusion (8) is provided on that end side of the plug (14) which is directed towards the swirl chamber (2).

4. The atomizer nozzle as claimed in claim 1, wherein the inlet channel (13) of each of said at least one feed channel (4) is oriented in the longitudinal direction of the nozzle.

5. The atomizer nozzle as claimed in claim 1, wherein the atomizer nozzle (1) has a plurality of the feed channels (4) which are distributed at uniform intervals in the circumferential direction.

6. The atomizer nozzle as claimed in claim 1, wherein the atomizer nozzle (1) is configured as a hollow-cone nozzle.

7. The atomizer nozzle as claimed in claim 1, wherein the outflow end region of the nozzle channel (5) has a cross-sectional widened portion which widens in a direction of the outflow end.

8. A sanitary outlet fitting with a water outlet which has at least one atomizer nozzle (1) as claimed in claim 1.

9. The outlet fitting as claimed in claim 8, wherein the water outlet is a shower head (21) or a jet regulator (17).

10. The outlet fitting as claimed in claim 9, wherein the water-outlet-form jet regulator (17) is installable in a sanitary outlet fitting on the outflow side.

11. The outlet fitting as claimed in claim 8, wherein the water outlet (17, 21) has at least two atomizer nozzles (1), which are distributed over a cross section of the water outlet.

12. The outlet fitting as claimed in claim 8, wherein the water outlet has a housing (18) or a basic structure (22), and the housing (18) or the basic structure (22) has provided in it at least one insertion opening (7; 23), into which the basic structure (10) of the atomizer nozzle (1) is insertable.

13. The outlet fitting as claimed in claim 8, wherein an attachment screen or filter screen (19) is arranged in front of the water outlet, which is jet regulator (17), and the attachment screen or filter screen (19) is fastenable on an inflow end side of the jet regulator.

14. The outlet fitting as claimed in claim 8, wherein the water outlet has at least three atomizer nozzles (1), and the atomizer nozzles (1) are arranged on a circular path or in a linear arrangement.

15. The outlet fitting as claimed in claim 14, wherein the longitudinal axes of the atomizer nozzles (1) are inclined in relation to one another such that liquid jets exiting from the atomizer nozzles (1) come into contact with one another at a predetermined distance from the atomizer nozzles (1).

16. An atomizer nozzle (1) for a sanitary water outlet, for atomizing water which is subjected to pressure, said atomizer nozzle (1) comprising a swirl chamber (2) in which at least one feed channel (4) opens, which is oriented transversely to a longitudinal axis of the nozzle and runs tangentially into the swirl chamber (2), at least one inlet channel (13) is arranged upstream of each said at least one feed channel (4), as seen in a flow direction, and the swirl chamber (2) tapers, in an outflow direction, towards a nozzle channel (5), at an end region of which a water jet exits into atmosphere, a basic structure (10) which has an insertion opening (11) on an inflow side, at least one groove (12), which forms the inlet channel (13), is provided on a circumferential wall of the insertion opening (11), a plug (14) that is insertable into the insertion opening (11) as far as an annular shoulder (15), which runs around an outermost portion of an inner circumference of the insertion opening and has at least one groove (16), is provided in order to form the at least one feed channel (4), and the plug (14) forms walls of the inlet and the feed channels (13, 4) which are directed towards the plug (14).

* * * * *